US005145120A

United States Patent [19]

Barclay

[11] Patent Number: 5,145,120

[45] Date of Patent: Sep. 8, 1992

[54] FIXED-WIDTH SHEAR MEMBERS FOR A WASTE REDUCTION APPARATUS

[76] Inventor: Randel L. Barclay, 5616 Carpenter Rd., Stockton, Calif. 95205

[21] Appl. No.: 638,444

[22] Filed: Jan. 4, 1991

[51] Int. Cl.[5] ..... B02C 15/00

[52] U.S. Cl. ..... 241/286; 241/295

[58] Field of Search ..... 241/236, 295; 83/664

[56] References Cited

U.S. PATENT DOCUMENTS

| | | | |
|---|---|---|---|
| 3,173,326 | 3/1965 | Gulliksen | 83/664 X |
| 3,279,296 | 10/1966 | Jung et al. | 83/664 |
| 3,662,934 | 5/1972 | Nara et al. | 83/664 X |
| 3,931,935 | 1/1976 | Holman . | |
| 3,991,944 | 11/1976 | Baikoff . | |
| 4,059,235 | 11/1977 | Bryant | 241/236 X |
| 4,241,882 | 12/1980 | Baikoff . | |
| 4,275,849 | 6/1981 | Chambers | 241/236 X |
| 4,374,573 | 2/1983 | Rouse et al. . | |
| 4,607,800 | 8/1986 | Barclay . | |
| 4,752,038 | 6/1988 | Takahashi et al. | 241/236 X |
| 4,757,949 | 7/1988 | Horton | 241/236 X |
| 4,901,929 | 2/1990 | Barclay . | |
| 4,925,116 | 5/1990 | Lundell | 241/236 |
| 4,961,540 | 10/1990 | Wiesemann | 241/236 X |

*Primary Examiner*—Mark Rosenbaum
*Assistant Examiner*—Frances Chin
*Attorney, Agent, or Firm*—Schneck & McHugh

[57] ABSTRACT

Apparatus for shearing waste material such as a discarded vehicle tire including parallel first and second rotatable shafts, each having an alternating pattern of driving rings and split sharpenable shear members along the length thereof. The driving rings and the shear members all abut the circumference of the associated shaft. The driving rings are keyed to the shafts and the shearing members are fixed to the driving rings. The shearing members of each shaft are axially aligned with the driving rings of the other shaft and are in meshing relation with the shearing members of the other shaft. The optimal edge-to-edge dimension of the shearing members is maintained after material reduction from the edges by insertion of a shim between the blades that comprise the split shearing members. After each periodic sharpening of the shear members, additional shim are added between the blades or the existing shims are replaced with larger shims.

16 Claims, 3 Drawing Sheets

FIXED-WIDTH SHEAR MEMBERS FOR A WASTE REDUCTION APPARATUS

TECHNICAL FIELD

The present invention relates generally to apparatus for conversion of solid waste materials into small pieces and more particularly to resharpenable waste reduction apparatus.

BACKGROUND ART

The problem of disposing of bulky waste materials is receiving increasing attention as existing landfills reach capacity and the availability of additional land for waste disposal decreases. Reducing waste, such as tires, in size permits volume densification and reduces the requirements of subsequent processing.

Machines which utilize paired shearing wheels to shred waste material into smaller pieces have been developed. For example, U.S. Pat. Nos. 4,901,929 and 4,607,800 to Barclay disclose machines in which counter-rotating shearing wheels overlap at the edges of shear members on the wheels to cut into the waste material like giant knives. Other patents teaching this type of machine include U.S. Pat. No. 4,374,573 to Rouse et al. and U.S. Pat. No. 3,931,935 to Holman. The Barclay, Rouse et al. and Holman machines are "primary" shredders in the sense that whole tires may be fed into the machines for shredding. As best seen in the above-cited U.S. Pat. No. 4,901,929 to Barclay, annular hubs are attached to the outside diameter of drive shafts and the shear members are fixed to the hubs. The term "shredder" as used herein means a machine which reduces objects by shearing action.

A second type of primary shredder is described in U.S. Pat. Nos. 3,991,944 and 4,241,882 to Baikoff. The Baikoff patents teach comminuting machines having counter-rotating shafts with comminutor rings. The rings include cutter-noses which come in close proximity to the outer diameter of the opposite shaft to which the rings are attached so as to provide the cutting action. The patents teach that the outer surfaces of the counter-rotating shafts act as anvils for the cutting action of the cutter-noses of the rings. The rings are attached to annular shaft-collars which extend from the outside diameter of the shafts. Thus, the shaft-collars are the functional equivalents of the shaft hubs of the other patents cited above.

While the primary waste-reducing machines of the prior art significantly reduce the size of tires and the like, in some applications it is desirable to provide further reduction. One method is to first freeze and then jolt the material to shatter the material. However, this can be an expensive method.

Wear of the shearing wheels is also an important concern. The clearance between overlapping adjacent edges of the shear members of the two shearing wheels must remain within a relatively small range for the shredder to operate effectively. The shear members therefore must be periodically replaced or resharpened. The above-cited patent to Rouse et al. teaches attaching resharpenable segments along the periphery of each shear member. However, resharpening requires removal of material along the overlapping adjacent edges, so that the clearance between edges is affected, as is the effectiveness of shredder. Consequently, the segments must be replaced regularly. The Barclay ('929) patent teaches a shear member having an overlapping radially outward end that is comprised of a center annular member extending from a hub and sandwiched between two resharpenable tool members. As a tool member is resharpened, a shim is placed between the center annular member and each tool member to maintain the clearance between adjacent shear members. The problem with this assembly is that the center annular members must have a sufficiently wide axial width to withstand the stresses encountered during the arduous task of shearing tires and the like. As a result, the minimum center-to-center pitch of the shear members is relatively large and the resulting reduction in size may not be sufficient for certain applications.

It is an object of the present invention to provide a shearing machine which has a fine pitch of resharpenable shearing members and which allows a greater number of shears without rendering the machine more susceptible to breakage resulting from the increased torque necessary to achieve the increase in shears. Another object is to provide such a machine which can be used as either a primary or secondary shearing machine.

SUMMARY OF THE INVENTION

The above objects have been met by a shearing machine having annular shear members which are axially split into abutting blade member pairs that do not require a center supporting structure. For example, a shear member may be a pair of parallel plates radially joined to a shaft, like turbine blades except fully perpendicular to the shaft axis. The blade members of a shear member abut each other, thereby allowing insertion of a clearance-maintaining shim between blade members after sharpening of the shear member. In contrast to the prior art, the shims are now internal to a shear member, rather than external. Moreover, rather than being attached to intermediate hubs or shaft-collars that are used to expand the outside diameter of a shaft at the shear members, the shear members have inside diameter portions, i.e. radially inward ends, which directly contact the circumferences of shafts that support the shear members. That is, the shear members are not held away from the shafts by intermediate hubs. This allows the shafts of the waste apparatus to have a larger diameter and, since a larger diameter shaft is better able to withstand an increase in torque, a more powerful drive may be utilized. Moreover, the larger diameter shafts are better structurally-suited for resistance to deflection of the shear members.

The apparatus includes parallel first and second rotatable shafts. Each shaft has an alternating pattern of driving rings and sharpenable shear members along the length of the shaft. The driving rings are fixed to the shafts by inwardly projecting keys that fit into shaft grooves. The shear members are bolted to the driving rings and the assemblies of shear members and driving rings are subjected to an extreme compression friction at opposed ends of the assemblies for the transmission of rotational motion from the shaft to the shear members.

The shear members of each shaft are axially aligned with the driving rings of the other shaft. The shear members of the first shaft mesh with the shear members of the second shaft. The overlapping of edges defines shear regions.

Each shear member has a desired edge-to-edge dimension slightly less than the axial dimension of the axially aligned driving ring on the other shaft. The shear member has a first and a second blade perpendicular to the axes of the shaft. Preferably, prior to the first sharpening of the shear members, the blades are in abutting relation. However, sharpening of the members requires removal of material at the edges of the shear members. Thus, the edge-to-edge dimension can no longer be slightly less than the axial dimension of the aligned driving ring on the opposite shaft. Therefore, replaceable shims are included for fastening between the two blades as sharpening is required. The replaceable shims increase the edge-to-edge dimension to the desired width. Subsequent sharpening is accompanied by either using wider shims or by adding shims to those already placed between the blades.

An advantage of the present invention is that the hubless construction allows use of larger diameter shafts. The larger diameter shafts are able to withstand a greater torque. Consequently, a greater horsepower drive can be utilized. The increase in horsepower is required for use of shear members having a fine pitch, since the fine pitch increases the linear frequency of shears. The present invention allows shredding of waste material at a faster pace and with a finer end product. Another advantage of the present invention is that the construction facilitates maintenance of the apparatus.

BEST MODE FOR CARRYING OUT THE INVENTION

Figure 1:
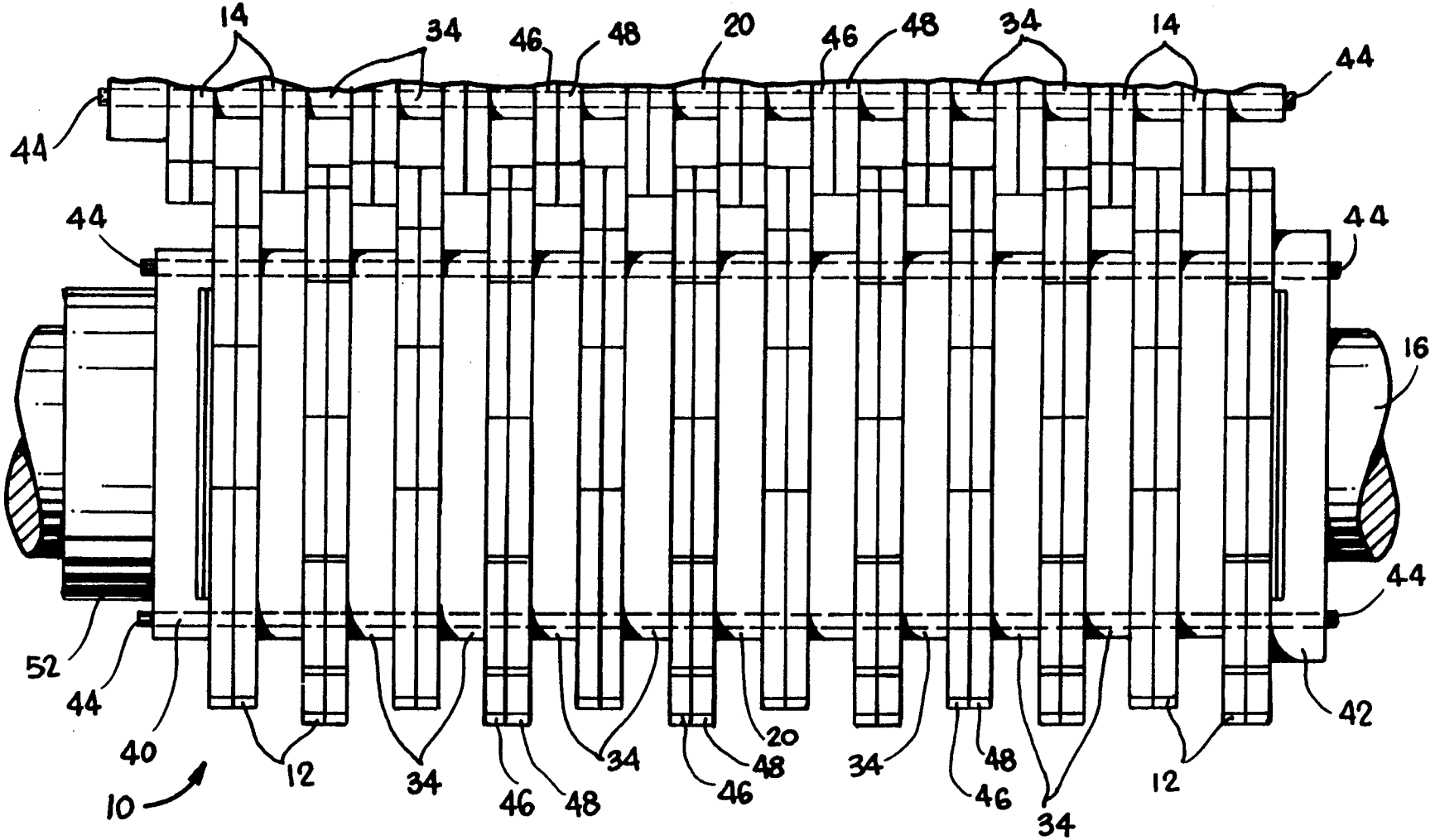
FIG. 1 is a top view of a rotary shear having shear members in meshing relation with other shear members.

With reference to FIG. 1, a rotary shear 10 of the present invention includes twelve shear members 12. The shear members 12 are spaced apart from each other by a distance to allow meshing of a second set of twelve shear members 14. The first set of shear members 12 is caused to rotate in a direction opposite to rotation of the second set of shear members 14 for the reduction of waste material into smaller pieces. The operation of the counter-rotating members 12 and 14 is described more fully in U.S. Pat. Nos. 4,901,929 and 5,100,069 to Barclay, incorporated herein by reference.

Unlike the shredding machines of the prior art, the rotary shear 10 does not include intermediate hubs for mounting the shear members 12 and 14 to the counter-rotating shafts. The shaft 16 has a large diameter mounting region. Because the circumference of the shaft 16 is further removed from the axis than is typical of shredding machines, the present invention is better able to withstand an increase in power for driving the shaft and the shear members fixed to the shaft. An increase in power is required to drive the rotary shear 10 having a greater linear frequency of cuts than typical prior art shears. Preferably, the center-to-center distance between shear members is 2 inches and the outside diameter of the mounting region of the shaft is 13.5 inches, but these dimensions are not critical. However, the finer pitch blades do not extend as far radially from the shaft as shear members of a coarse pitch shredding machine might.

The mounting region of the shaft 16 includes a center registration spacer 20. The registration spacer is fixed relative to the shaft so that the axis of the registration spacer is coincident with the axis of the shaft. Preferably, the registration spacer is an integral part of the shaft. The registration spacer 20 acts as a stationary, right-angle register of the shear members 12. That is, the registration spacer squares two groupings of six shear members. During operation, the registration spacer prevents skewing of the shear members. The registration could occur at one end of the assembly of shear members, but placement at the center halves the manufacturing error and creates a better embodiment.

Figure 2:
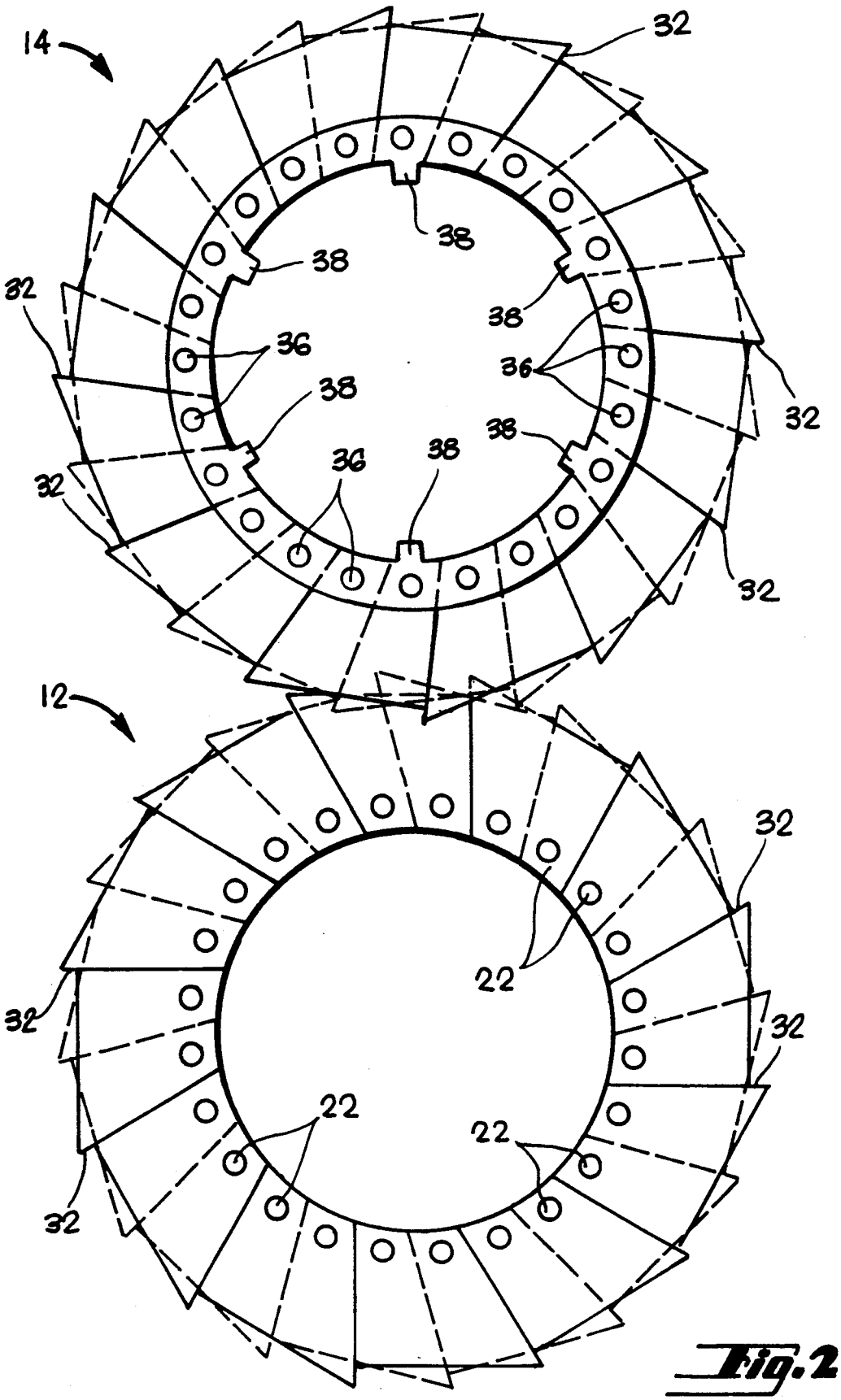
FIG. 2 is a side view of the meshing shear members of FIG. 1.
Figure 3:
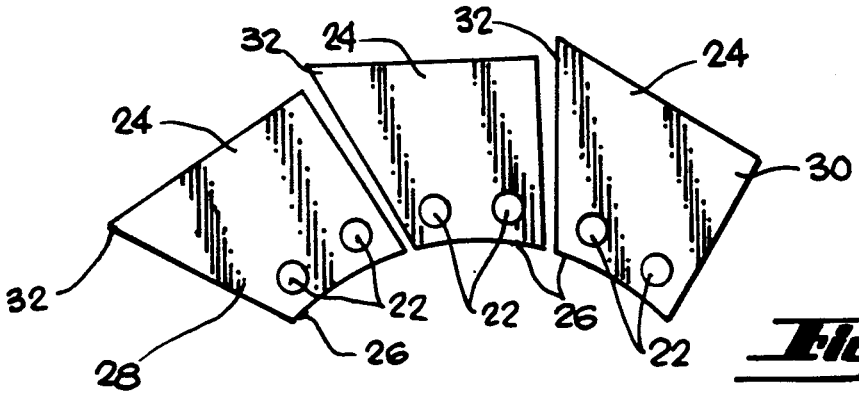
FIG. 3 is a side view of a portion of the shear members of FIG. 2.

Referring now to FIGS. 2 and 3, a first shear member 12 is attached to the center registration ring. The shear member has an array of bores 22 corresponding to an array of bores within the center registration spacer, not shown. Preferably, the shear members are comprised of a number of segments 24, as best seen in FIG. 3. As will be explained more fully below, the segments are coupled to the center registration spacer by fastening studs which pass through the bores in the segments 24 and the center registration spacer. The segments 24 are mounted so that the radially inward surface 26 contacts the mounting region of the shaft. The lead edge 28 of each segment 24 extends radially outward beyond the extent of the trail edge 30 of an adjacent segment to form a tooth 32. The segments are constructed of hardened, wear-resistant material suitable for cutting into discarded tires, appliances and the like. For example, a high grade tool steel may be used.

Figure 4:
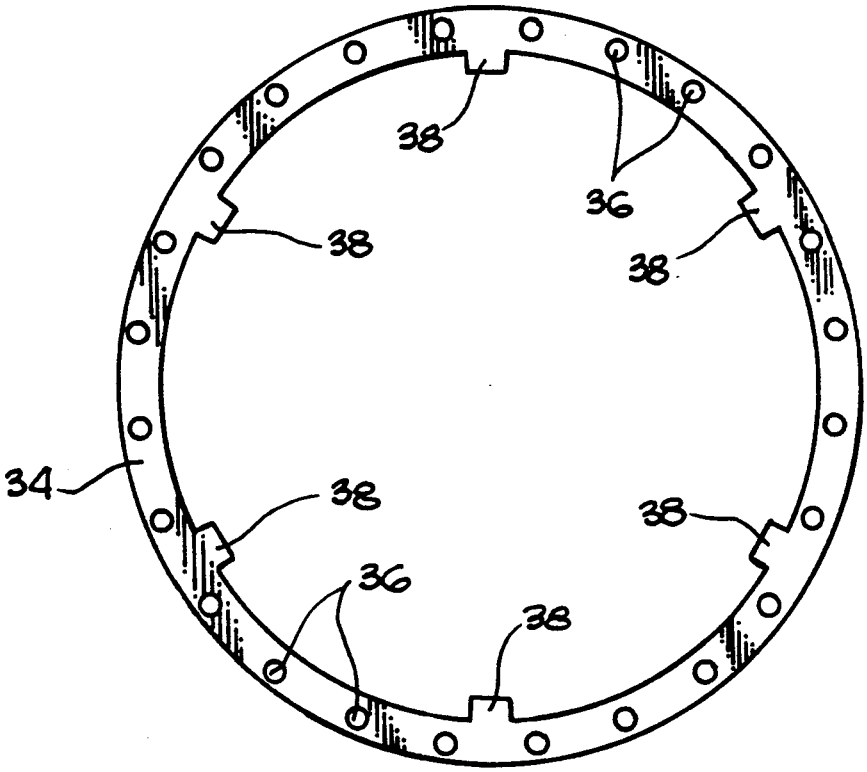
FIG. 4 is a side view of a driving ring of FIG. 1.

Adjacent to the shear member 12 which abuts the center registration spacer is a driving ring 34, shown in FIGS. 2 and 4. In constructing the counter-rotating shaft assemblies, the shear members 12 of one shaft will be axially aligned with the driving rings 34 of the other shaft. The driving rings 34 have an array of bores 36 which corresponds to the array of bores 22 in the shear members 12 and 14 and to the bores in the registration spacer. The driving ring 34 includes six equidistantly spaced keys 38 which are received within key grooves of the shaft. After insertion of the keys 38 within the shaft grooves, the driving ring 34 is forced to rotate with the shaft. Because the shear members 12 and 14 are bolted to the driving rings and because the shear members and driving rings are subjected to extreme compression friction, the rotational motion of the shafts is transmitted to the shear members.

Returning again to FIG. 1, the shaft is assembled to have an alternating pattern of shear members 12 and driving rings 34. The six shear members and five driving rings 34 on one side of the registration spacer 20 are sequentially positioned, whereafter a compression cap 40 is utilized to provide a force which presses the six shear members 12 and the driving rings 34 against the center registration spacer 20. In identical fashion, the six shear members on the opposite side of the registration spacer are installed and a compression cap 42 provides the force for ensuring that the shear members remain in alignment with each other and with the shear members 14 of the opposite shaft. As described above, the driving rings 34 are keyed to the shaft 16 for rotation therewith. Rotational motion is transmitted to the shear members 12 by the compression friction created at caps 40 and 42 and also by a ring of fastening studs which pass through the compression caps 40 and 42 as well as the driving rings 34 and the segments of the shear members 12. Nuts 44 at the opposed threaded ends of the fastening studs secure the fastening studs in position.

In a preferred embodiment, the shear members 12 and 14 have a width of one inch. In such case, the width of the registration spacer 20 and the driving rings 34 should be slightly greater than one inch so that the counter-rotating shear members of the opposite shaft assembly can be brought into meshing relationship. Where the shear members 12 and 14 have a width of one inch, the registration spacer and the driving rings 34 may have an axial width of 1.005 inch. While not illustrated, there is a small gap between adjacent shear members 12 and 14. The size of the gap is important. Excess clearance causes the shear members to tear rather than to cut the waste material, while too close of a spacing causes premature wear of the shear members. Preferably, the axial gap should be 0.002 inch and should not exceed 0.03 inch.

Due to the arduous nature of shearing waste material, the edges of the shear members 12 and 14 wear with use. However, the members are made of a material which allows resharpening. When wear is excessive, the members can be removed and the grinding process can then be employed to return the shear members to a condition in which the opposed faces are planar.

Figure 5:
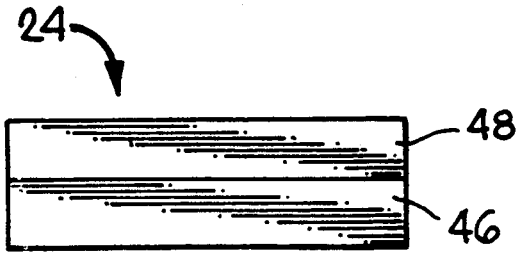
FIG. 5 is a top view of an unsharpened shear member.

The sharpening of the opposed sides of the shear members 12 and 14 is by a process of grinding material. Consequently, the axial width of the shear members 12 and 14 is no longer the desired width for achieving the most effective shearing of waste material. Grinding of material from the opposed edges of the shear members increases the gap between the shear members 12 of one shaft 16 and the shear members 14 of the parallel shaft. The present invention overcomes the detrimental effect of sharpening by constructing each shear member 12 and 14 of two blades 46 and 48. The two-blade construction of a single segment 24 of a shear member is best illustrated in FIG. 5. The two blades 46 and 48 are shown as identical parallel plates, but this is not critical.

The pair of blades 46 and 48 are in abutting relation when the shear member 12 is first manufactured and installed on the shaft assembly. However, after a first sharpening of the grind-depreciable shear members the blades no longer combine to provide the desired axial width of the shear members. Instead, the shear members of one shaft assembly would be spaced apart from the shear members of the other shaft assembly by a distance which would inefficiently reduce the size of waste material.

Figure 6:
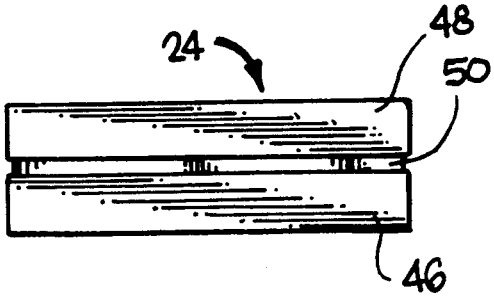
FIG. 6 is a top view of the shear member of FIG. 5 after sharpening of the shear member.

Referring now to FIG. 6, the double-bladed construction of the shear member segments 24 allows insertion of a shim 50 therebetween. The shim has a width which increases the overall width of the segment 24 to the dimension prior to grinding of the material from the segments 24. If, for example, the shear member is ground to remove 0.015 inch from each side of the shear member, the shim should have a width of 0.030 inch. This again achieves the optimal width of the segments 24 for shearing of waste material.

The shaft assembly can then be reassembled so that the stud-and-nut assemblies 44 and the compression caps 40 and 42 again attach the spacers 20 and 34 to the shear members 12 and 14, as shown in FIG. 1. The compression caps 40 and 42 are secured in position by an internally-threaded nut 52. The internally-threaded nut 52 is shown on only one side of the rotary shear 10, but in operation both compression caps 40 and 42 are abutted by such a nut 52 for creation of an extreme compression force.

The distance between shear members 12 on a shaft 16 and the distance between a shear member on one shaft and a driving ring 34 on another shaft determine the size of waste material exiting from the rotary shear 10. The pitch of the shear members 12 should be in the range of 0.25 inch to 3 inches, but this is not critical. The present invention has the potential of cutting scrap tires into squares of less than 1 inch by 1 inch.

The rotary shear 10 also includes ploughs, not shown, which are employed to remove shredded material trapped between adjacent shear members 12 during operation of the apparatus. The ploughs may include a plurality of stationary fingers, with each stationary finger being inclined to project into the spacing between adjacent shear members 12 and 14 to strip shredded material therefrom. Alternatively, each of the counter-rotating shafts may be operatively associated with a rotary plough which reaches into the spacing between the shear members on the shaft to strip away shredded material. The rotary plough is driven to rotate in a direction opposite to that of the associated shaft.

While the present invention is illustrated in FIG. 1 as having abutting blades 46 and 48 prior to sharpening of the shear members 12 and 14, a shim may be included in the original assembly. Preferably, the shims are segmented in the same manner as the shear members 12 and 14, but this is not critical.

I claim:

1. A rotary shear apparatus comprising, parallel first and second rotatable shafts, a plurality of driving ring means fixed to the circumferences of said first and second shafts for rotation therewith, and first and second sets of generally annular shear members mounted to said driving ring means so as to be driven by said driving ring means, rotation of said shaft translated to said shear members by said driving ring means, said first set of shear members being mounted to driving ring means of said first shaft and being in meshing relation with said second set of shear members mounted to said driving ring means of said second shaft to form cutting regions along opposed edges of each shear member, said shear members of said first and second sets each being split to form a pair of abutting blades perpendicular to the axis of said shafts, thereby allowing insertion of a shim member between said abutting blades upon sharpening material-reduction at said opposed edges of shear members, each blade being segmented and having segments individually mounted to said driving ring means.

2. The apparatus of claim 1 wherein said driving ring means of each of said first and second shafts space apart the shear members of said shaft and wherein said shear members space apart said driving ring means.

3. The apparatus of claim 2 wherein said driving ring means are each generally annular members, each having an inside diameter slightly greater than the diameter of said shaft to which the annular member is fixed.

4. The apparatus of claim 3 wherein said shear members each have an inside diameter generally equal to the inside diameter of said annular members and having an outside diameter greater than the outside diameter of said annular members.

5. The apparatus of claim 3 wherein said annular members each have keys projecting inwardly from said inside diameter to fit within grooves in said shaft.

6. The apparatus of claim 1 wherein said shear members are mounted to said driving ring means by a plurality of bolts passing through said shear members and said driving spacer means.

7. The apparatus of claim 1 further comprising said shim members disposed between said blades of pairs of blades, said shim members spacing apart said blades by a distance to maintain the edge-to-edge dimension of said shear members, said shim members being segmented.

8. A rotary shear apparatus comprising, a first rotatable shaft, a first set of spaced apart driving rings mounted to the circumference of said first shaft for rotation therewith, each driving ring having a width parallel to the axis of said first shaft, a first set of shear members mounted to said driving rings so as to be driven by said driving rings, said shear members and driving rings disposed in alternating fashion to space apart adjacent shear members by said width of said ring between said adjacent shear members, a second rotatable shaft having an axis parallel to said axis of the first shaft, a second set of spaced apart driving rings mounted to the circumference of said second shaft, and a second set of shear members mounted to said second set of driving rings so as to be driven by said second set of driving rings, said shear members and driving rings disposed to form an alternating pattern similar to the pattern of said first shear member, said shear members of said first set meshing with said shear members of said second set, said shear members of each of said first and second sets having a desired width wherein said first set of shear members have opposed cutting edges closely spaced from cutting edges of said meshing second set of shear members, said shear members made of a material adapted for sharpening by material removal from said cutting edges, said shearing members being split into first and second blades to allow insertion of a shim member therebetween to maintain said desired width upon said sharpening each blade being segmented.

9. The apparatus of claim 8 wherein each blade has a plurality of arcuate segments arranged to form a generally annular configuration, each arcuate segment mounted to a driving ring.

10. The apparatus of claim 8 wherein said first set of shear members are axially aligned with said second set of rings, said desired width of a shear member being slightly less than the width of the driving rings axially aligned with said shear member.

11. The apparatus of claim 10 further comprising said shims between said blades and replacement shims, said segmented replacement shims being inserted between said blades upon said material removal from said cutting edges, thereby maintaining said desired width.

12. The apparatus of claim 11 wherein said blades and said segmented replacement shims are secured to said driving rings by bolts and wherein caps attached at opposed ends of said sets of shear members create a compression friction for transmission of rotational motion from said shafts to said sets of shear members.

13. A rotary shear apparatus comprising, parallel first and second rotatable shafts, each having an alternate pattern of driving rings and sharpenable shear members along the length thereof, said driving rings fixed to said shafts and said shear members for translation of rotational motion from said shafts to said shear members, the shear members of each shaft axially aligned with driving rings of the other shaft and meshing with said shear members of the other shaft, each shear member having a desired edge-to-edge dimension slightly less than the axial dimension of the axially aligned driving ring of the other shaft, said shear members each being axially split to form a pair of blades and each blade being segmented by radial slits therethrough, and a plurality of replaceable shims disposed between said pair of blades of said shear members, said blades of said shear members spaced apart by the axial dimension of said replaceable shims, thereby allowing maintenance of said desired edge-to-edge dimension of said shear members by replacement of said shims with axially longer shims upon the sharpening of said shear members.

14. The apparatus of claim 13 wherein said driving rings include keyed rings and registration rings, said keyed rings being removable from said shafts and having inwardly projecting keys received within grooves of said shafts, said registration rings being integral portions of said shafts.

15. The apparatus of claim 13 wherein each of said shims has a segmented construction.

16. The apparatus of claim 13 further comprising compression caps at opposed ends of said shear members.

* * * * *